US008905046B2

(12) United States Patent
Carvalho

(10) Patent No.: US 8,905,046 B2
(45) Date of Patent: Dec. 9, 2014

(54) METHOD AND APPARATUS FOR CLIP-IN HAIR EXTENSIONS

(71) Applicant: Tatiana M. Carvalho, Santa Clara, CA (US)

(72) Inventor: Tatiana M. Carvalho, Santa Clara, CA (US)

( * ) Notice: Subject to any disclaimer, the term of this patent is extended or adjusted under 35 U.S.C. 154(b) by 0 days.

(21) Appl. No.: 13/844,691

(22) Filed: Mar. 15, 2013

(65) Prior Publication Data

US 2014/0261529 A1 Sep. 18, 2014

(51) Int. Cl.

| | |
|---|---|
| ***A45D 24/38*** | (2006.01) |
| ***A41G 3/00*** | (2006.01) |
| ***A41G 5/00*** | (2006.01) |
| ***A45D 8/12*** | (2006.01) |
| ***A45D 8/22*** | (2006.01) |
| ***A45D 8/28*** | (2006.01) |
| ***A45D 8/24*** | (2006.01) |

(52) U.S. Cl.

CPC ..... *A41G 5/0073* (2013.01); *A45D 8/24* (2013.01)

USPC ..... 132/144; 132/201; 132/54; 132/275; 132/278

(58) Field of Classification Search

CPC ..... A41G 5/0053; A41G 5/0073; A45D 8/12; A45D 8/14; A45D 8/16; A45D 8/26; A45D 8/34; A45D 8/00; A45D 8/24; A45D 2/42

USPC ..... 132/144, 201, 63.1, 212, 219, 105, 106, 132/107, 121, 135, 145, 146, 148, 151, 270, 132/273, 275, 276, 277, 278, 53–56; 2/171, 2/207, DIG. 11; 24/460, 487, 489, 563, 24/572.1, 578.12, 582.11, 586.11, 16 PB

See application file for complete search history.

(56) References Cited

U.S. PATENT DOCUMENTS

| | | | | | |
|---|---|---|---|---|---|
| 673,650 | A | * | 5/1901 | Nowacke | 132/144 |
| 739,560 | A | * | 9/1903 | Roehme et al. | 132/106 |
| 886,034 | A | * | 4/1908 | Bechtold | 132/106 |
| 1,241,960 | A | * | 10/1917 | Gould | 132/137 |
| 1,595,595 | A | * | 8/1926 | Bonat et al. | 132/105 |
| 1,775,209 | A | * | 9/1930 | Oppenheim | 132/105 |
| 2,509,658 | A | * | 5/1950 | Wallace | 606/204.35 |
| 2,651,310 | A | * | 9/1953 | Selson | 132/274 |
| 2,818,871 | A | * | 1/1958 | Beaudry | 132/278 |
| 3,120,852 | A | * | 2/1964 | Sawyer | 132/145 |
| 3,412,739 | A | * | 11/1968 | Thatcher | 132/278 |
| 5,666,982 | A | * | 9/1997 | Pignon | 132/279 |
| 5,862,814 | A | * | 1/1999 | Janik et al. | 132/275 |
| 5,937,867 | A | * | 8/1999 | Williams | 132/201 |
| 6,019,107 | A | * | 2/2000 | Overmyer et al. | 132/53 |
| 6,142,158 | A | * | 11/2000 | Lloyd et al. | 132/275 |

(Continued)

*Primary Examiner* — Vanitha Elgart

(74) *Attorney, Agent, or Firm* — Perkins Coie LLP

(57) ABSTRACT

A hair extension device can include single and dual clip member apparatuses. Hair extension tracks can be applied to the outer surface areas of an apparatus, along the upper edge of a clip member, allowing hair extensions to lie over the entire outer region of the clip. The entire outer surface areas of said clip member apparatuses can contain no holes or at least one row of holes at the top edge of a clip member, providing various means for attaching hair extension tracks. The natural hair can be secured to an apparatus by a row of comb-like teeth that point upward against the scalp when properly applied, providing complementary mating between that natural hair and the slots formed at the base of the comb-like teeth, or by placing the hair in between the apparatus. An apparatus can be opened and closed by snap-action lock.

17 Claims, 18 Drawing Sheets

(56) References Cited

U.S. PATENT DOCUMENTS

| | | | | |
|---|---|---|---|---|
| 6,237,610 | B1 * | 5/2001 | Trevisan | 132/273 |
| 6,612,312 | B2 * | 9/2003 | Silva | 132/200 |
| 6,634,366 | B1 * | 10/2003 | Simmons et al. | 132/53 |
| 6,681,779 | B2 * | 1/2004 | Stachowski | 132/279 |
| 7,168,432 | B1 * | 1/2007 | Brumfield | 132/53 |
| 7,343,921 | B2 * | 3/2008 | Salinas | 132/201 |
| 8,191,556 | B2 * | 6/2012 | Betts | 132/201 |
| 8,631,804 | B2 * | 1/2014 | Umezu et al. | 132/54 |
| 2005/0194015 | A1 * | 9/2005 | Watts | 132/53 |
| 2006/0005849 | A1 * | 1/2006 | Thomas-Dupree | 132/54 |
| 2008/0190442 | A1 * | 8/2008 | Kwak | 132/273 |
| 2008/0223390 | A1 * | 9/2008 | Brown | 132/201 |
| 2009/0032042 | A1 * | 2/2009 | Fitzpatrick | 132/54 |
| 2012/0125356 | A1 * | 5/2012 | Alex | 132/201 |
| 2013/0042881 | A1 * | 2/2013 | Mutchler | 132/201 |
| 2013/0180540 | A1 * | 7/2013 | Di Biase | 132/201 |

* cited by examiner

METHOD AND APPARATUS FOR CLIP-IN HAIR EXTENSIONS

BACKGROUND

In recent years, hair extensions have increasingly become popular among people of all ages, including many of today's most famous celebrities. Hair extensions are commonly used to add volume, length and/or color to the wearer's natural hair. Hair extensions may also model a trend. For example, feather extensions are quickly gaining popularity internationally and are being used by people of all ages. Types of hair extensions available include those made from human hair, synthetic fibers and animal hair. Unfortunately, even with the wide variety of hair extensions available, users of hair extensions are faced with concerns relating to the time, effort and expenses of using hair extensions.

The time, effort and expenses associated with hair extensions vary based on the application method and how the method is achieved. Often hair extensions include strands and wefts which are two different formats for hair extensions that can be applied using several different techniques. The strands format involves adding hair extensions to small sections of existing hair, while the weft format involves adding hair around the head to larger widths of existing hair. In general, hair extensions can be weaved, braided, fused, clamped, bonded or clipped in.

Although hair extensions are a useful solution for added volume, length and/or color to a wearer's natural hair, conventional solutions used for hair extension application may require the experience of a hair dresser or hair weaver, and can therefore be costly. For example, the variety of different hair extension techniques may be damaging to the wearer's natural hair where chemicals, waxes and tools may be required for proper removal. As a result, the application technique for conventional solutions may not be convenient and/or time efficient. Thus, conventional hair extension devices and techniques, such as weaved, braided, fused, clamped, or bonded, may be difficult for the wearer to apply and remove on their own without damaging the natural hair.

Furthermore, conventional hair extension devices and techniques are not entirely satisfactory and hold various disadvantages. For example, where the clip-in hair extension system and method attempts to alleviate the problem wearers have with the time and cost associated with practical methods that require the assistance of a hair dresser or hair weaver, they nevertheless create other problems.

For instance, when the clip is properly applied to the natural hair, the row of comb-like teeth is pointing in a downward direction against the scalp which may permit the clip to slide or move down the natural hair if any force or weight is placed over the instant hair extension, also known in the art as hair weave, since the natural hair falls in the same direction as the comb-like teeth. As a result, the clips do not firmly and securely stay in place and can be difficult to snap on and off. This can quickly become cumbersome if the wearer wants to routinely apply clip-in hair extensions. In addition, a hair extension track may only be applied to the clip by means of a needle and thread which can also be inconvenient and time-consuming. Thus, the conventional solution used in the clip-in hair extension method may be deficient in allowing a wearer to feel confident in the overall function and comfort of the clip with respect to the attachment of the hair extension to the clip and the attachment of the clip to the wearer's natural hair.

SUMMARY

The present disclosure provides a variety of method, apparatus and a paradigm for facilitating and providing hair extensions. In one embodiment, a hair extension apparatus includes a single clip member. In another embodiment, an apparatus includes dual clip members. Hair extension tracks can be applied to the outer surface areas of single and dual clip member apparatuses, along the upper edge of a clip member, so that hair extensions may lie over the entire outer region of the clip. The entire outer surface areas of said clip member apparatuses can contain no holes or at least one row of holes at the top edge of a clip member. In this manner, hair extension tracks can be attached using various attachment mechanisms.

Attachment mechanisms may include tape, glue, wax or thread used in the art of hair extensions. In a single clip member apparatus, the natural hair is secured by a row of comb-like teeth that point upward against the scalp when properly applied, providing complementary mating between that natural hair and the slots formed at the base of the comb-like teeth. In a dual clip member apparatus, the natural hair is secured by placing the hair in between each clip member. The inner surface area of a dual clip member apparatus includes snaps on one clip member and corresponding openings on the other. The corresponding openings may extend partially or all the way through the outer surface of a clip member. Single and dual clip member apparatuses can be opened and closed by snap-action lock.

Another embodiment provides a method for instant clip-in hair extension applications. First, a determination is made as to whether the wearer wants to customize their clip-in hair extension device. For a customized hair extension device, the color, size and placement of the clips may be selected and purchased based on preference. In addition, a particular type, quality, color and length of hair extension tracks, also known in the art as hair weave, is selected. Next, the type of material to be used as an attachment mechanism (e.g. tape, glue, wax or thread), with respect to the hair extension tracks and the apparatus, is selected. For example, the hair extension tracks can be attached to the outer surface areas, longitudinally across the top edge, of single and dual clip member apparatuses.

In one possible dual clip member apparatus, a bottom clip member is first applied and secured to the natural hair, and then a top clip member, last. In addition, multiple apparatuses may be used in a hair extension device with one or more hair extension tracks attached, providing hair extensions to larger widths of natural hair around the head. In this manner, hair extensions are more easily blended and devices are concealed to achieve the realistic appearance of natural and fuller looking hair.

BRIEF DESCRIPTION OF THE DRAWINGS

The accompanying drawings, which are incorporated in and form a part of this specification and in which like numerals depict like elements, illustrate embodiments of the invention and, together with the description, serve to explain the principles of the invention. Unless otherwise noted, the drawings are not drawn to scale.

DETAILED DESCRIPTION

Reference will now be made in detail to various embodiments of the invention, such as a hair extension apparatus also referred to as a hair extension clip used in the hair extension application process. While the invention will be described in conjunction with these embodiments, it is understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the invention, numerous specific details are set forth in order to provide a thorough understanding of the invention. However, it will be recognized by one of ordinary skill in the art that the invention may be practiced without these specific details.

Some embodiments of the present invention which follow will refer specifically to the Figures. The descriptions and representations are the means used by those skilled in the art to most effectively convey the substance of their work to others skilled in the art.

Figure 1:
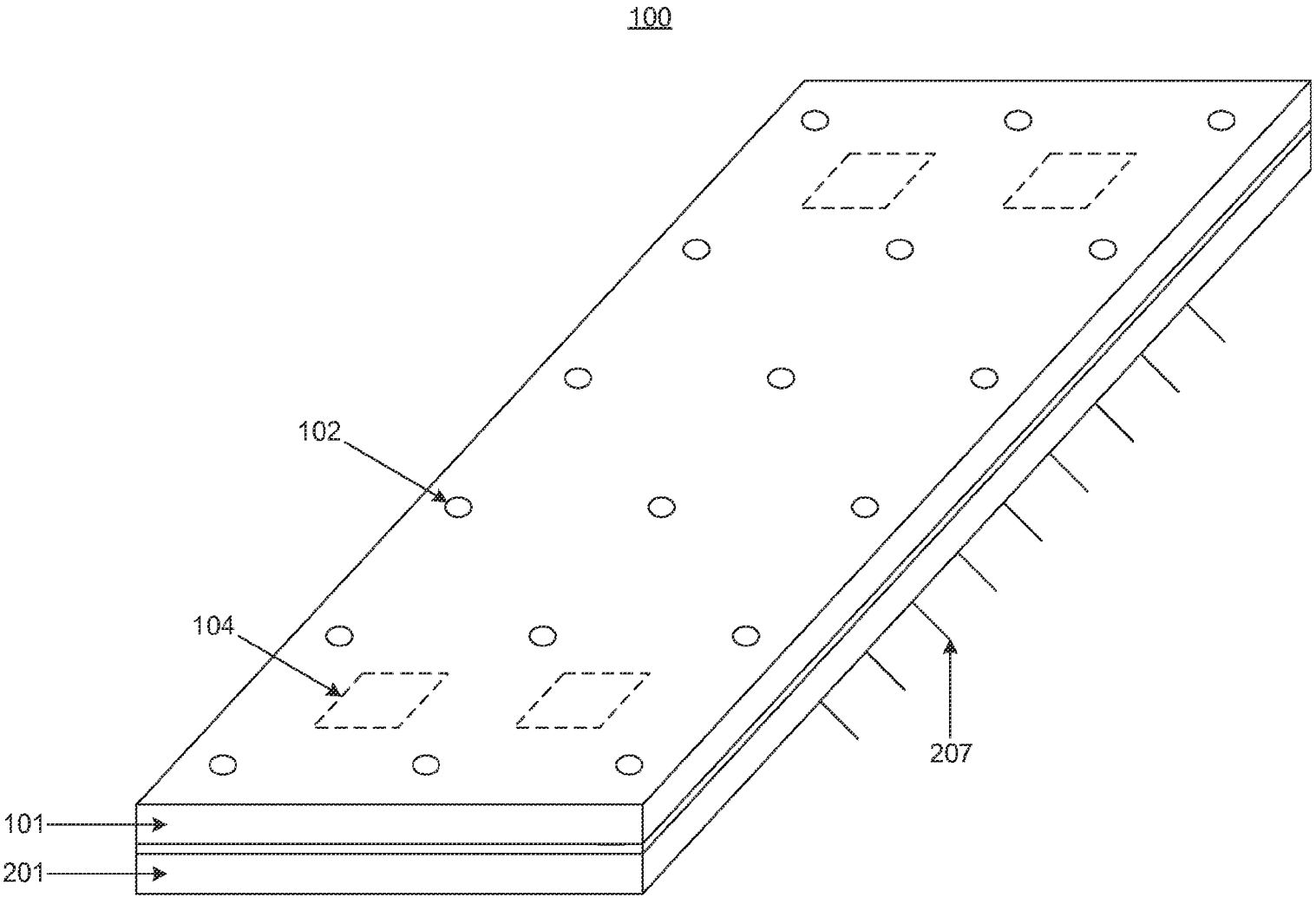
FIG. 1 illustrates an example of a hair extension apparatus for a user friendly hair extension application process, in accordance with embodiments of the present invention.

FIG. 1 illustrates an example of an apparatus comprising dual clip members for a clip-in hair extension device in accordance with embodiments of the present invention. Although specific components are disclosed in apparatus 100 it should be appreciated that such components are examples. That is, embodiments of the present invention are well suited to having various other components or variations of the components recited in apparatus 100. The components of apparatus 100 may operate with components other than those presented, and not all of the components of apparatus 100 may be required to achieve the goals of apparatus 100. Embodiments of apparatus 100 may include a variety of component options based on the application preferences of the hair extension wearer.

Figure 6:
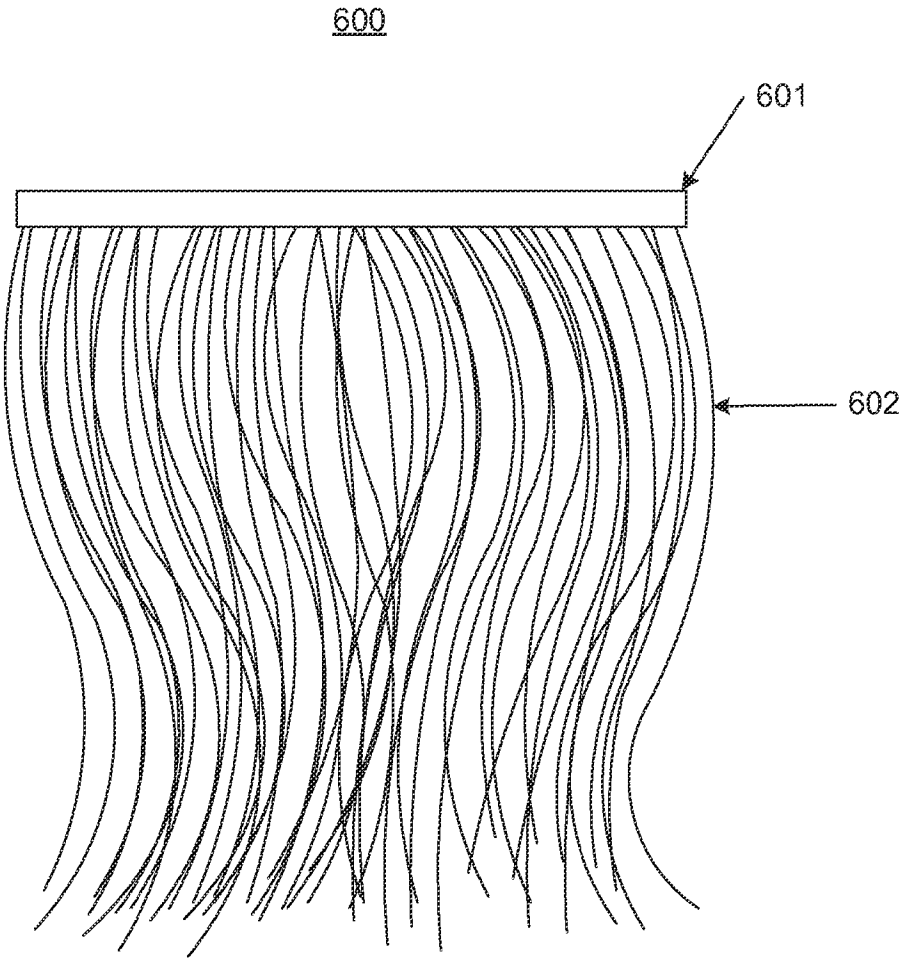
FIG. 6 (CONVENTIONAL ART)
FIG. 6 illustrates a front view of a hair extension track ready to be attached to the hair extension apparatus, in accordance with embodiments of the present invention.

As illustrated in FIG. 1, apparatus 100 may include, but is not limited to, two clip members, 101 and 201, also referred to as a top clip member 101 and a bottom clip member 201, optional comb-like teeth 207 for additional grip to the wearer's natural hair, and optional small holes 102 which can be utilized for attaching hair extension tracks 600 by thread, as further illustrated in FIG. 6. Apparatus 100 may also include two or more openings 104 utilized on the top clip member 101 with corresponding opposing snaps 204 (FIG. 3B) on the bottom clip member 201 to open and close apparatus 100. Apparatus 100 can be formed of any suitable material, such as metal, rubber, plastic or any combination thereof. In addition, apparatus 100 may include slip resistant materials and be arcuate in shape to conform to the shape of a wearer's head. In one embodiment apparatus 100 may be a single clip member 600, as later described in FIG. 10.

In accordance with embodiments of the present invention, apparatus 100 provides consumers with a self-applicable, less time-consuming and less damaging process for applying hair extensions. This process can also be less expensive than it would be if a consumer were to get hair extensions applied by a professional hair stylist since the cost for service is eliminated. Additionally, apparatus 100 provides a hair extension wearer with options for customization and application techniques with respect to attaching hair extension tracks to the apparatus and then to the natural hair.

Figure 7A:
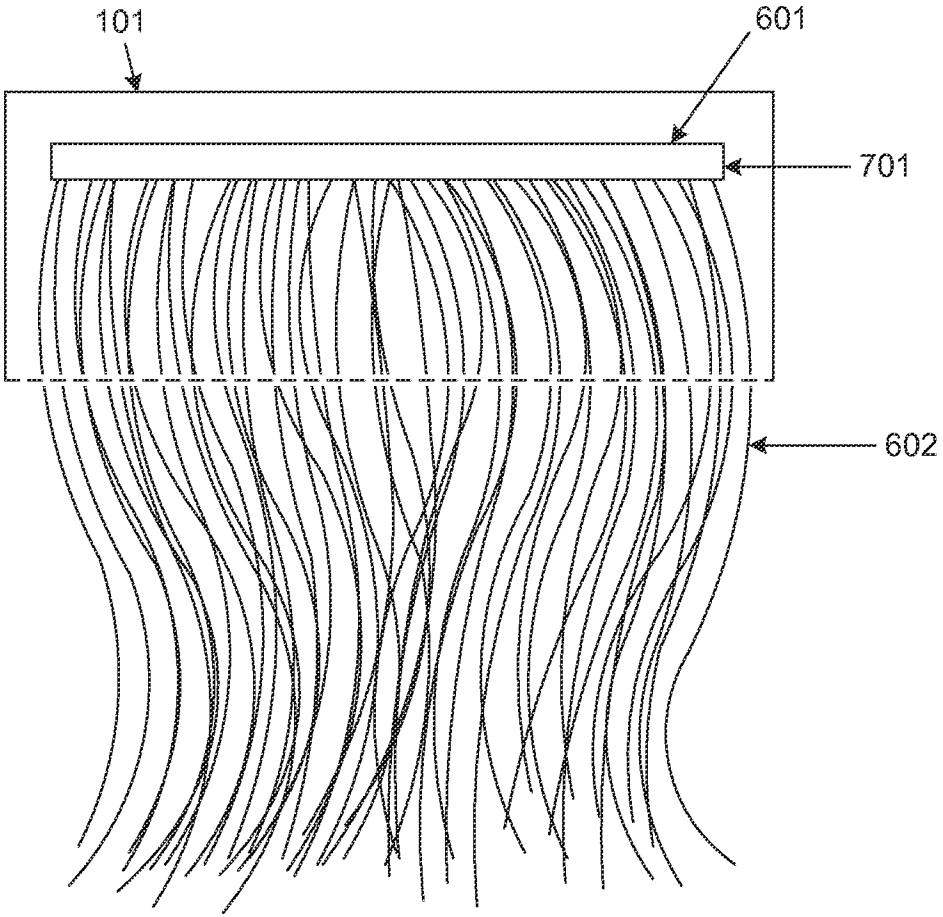
FIG. 7A illustrates a front view of a hair extension track as it appears when it is attached to one apparatus, in accordance with embodiments of the present invention.
Figure 7B:
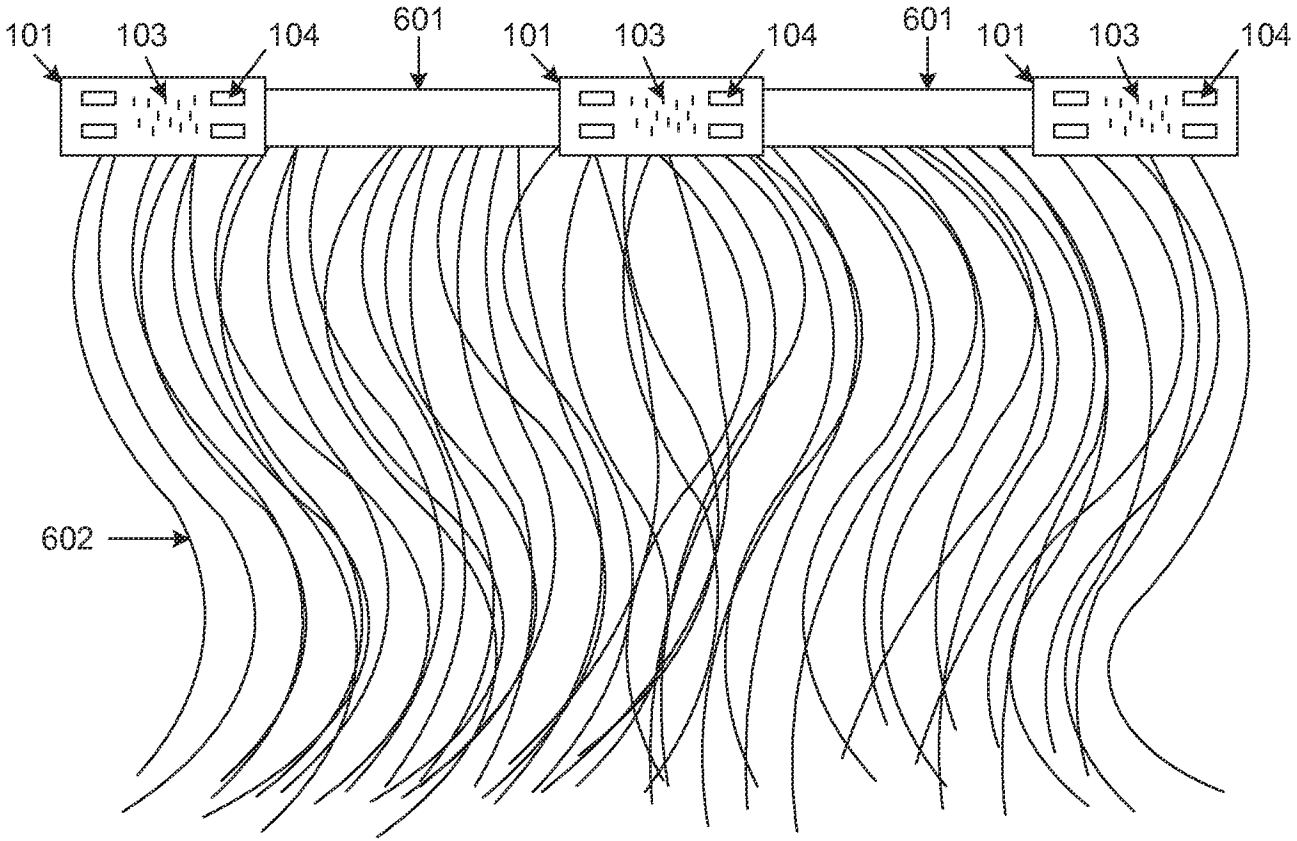
FIG. 7B illustrates a detailed back view of a hair extension track as it appears when attached to the outer surface of one or more clip members, in accordance with embodiments of the present invention.

Apparatus 100 may be fabricated in a variety of colors and sizes to match different hair colors and placement needs, in accordance with embodiments of the present invention. It is appreciated that the wearer may customize a hair extension device based on particular preferences. For example, the wearer can select the type, quality, color and length of hair extension tracks to attach to the apparatus. One or more hair extension tracks 600 (FIG. 6) may be attached to one or more apparatuses 100 to achieve a hair extension device as illustrated in FIGS. 7A and 7B. Multiple hair extension tracks 600 can be layered and attached to the outer surface of the top clip member 101 and/or bottom clip member 201 for a fuller hair extension. It is further appreciated that one or more apparatuses 100 can be attached at different points of the hair extension track 600 to provide larger widths of hair extensions that can be attached around the head at one time to blend and conceal the hair extensions and enhance the appearance of more full and natural looking hair.

Figure 2A:
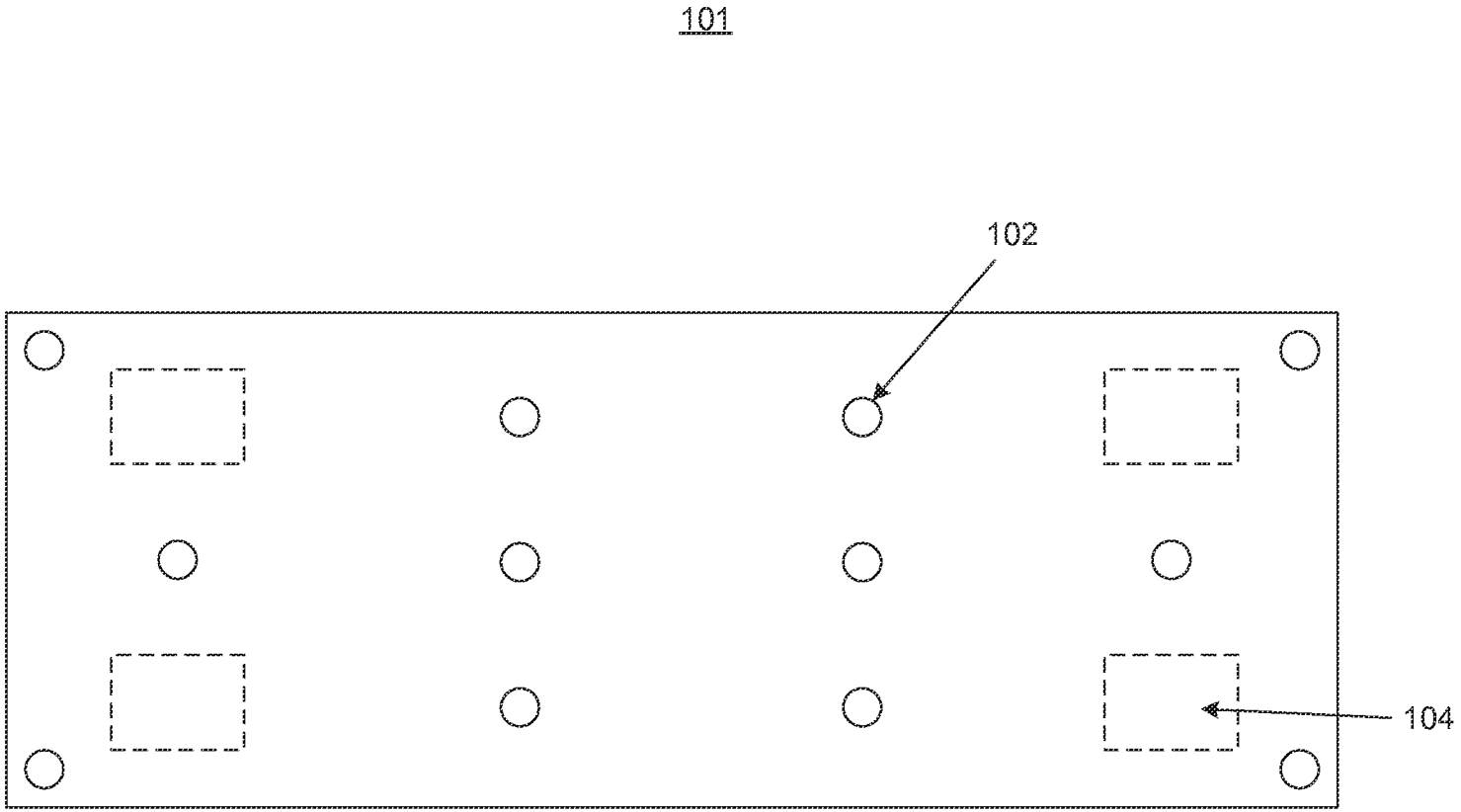
FIG. 2A illustrates a plan view of the outer surface of a top clip member for attaching hair extension tracks, in accordance with embodiments of the present invention.
Figure 2B:
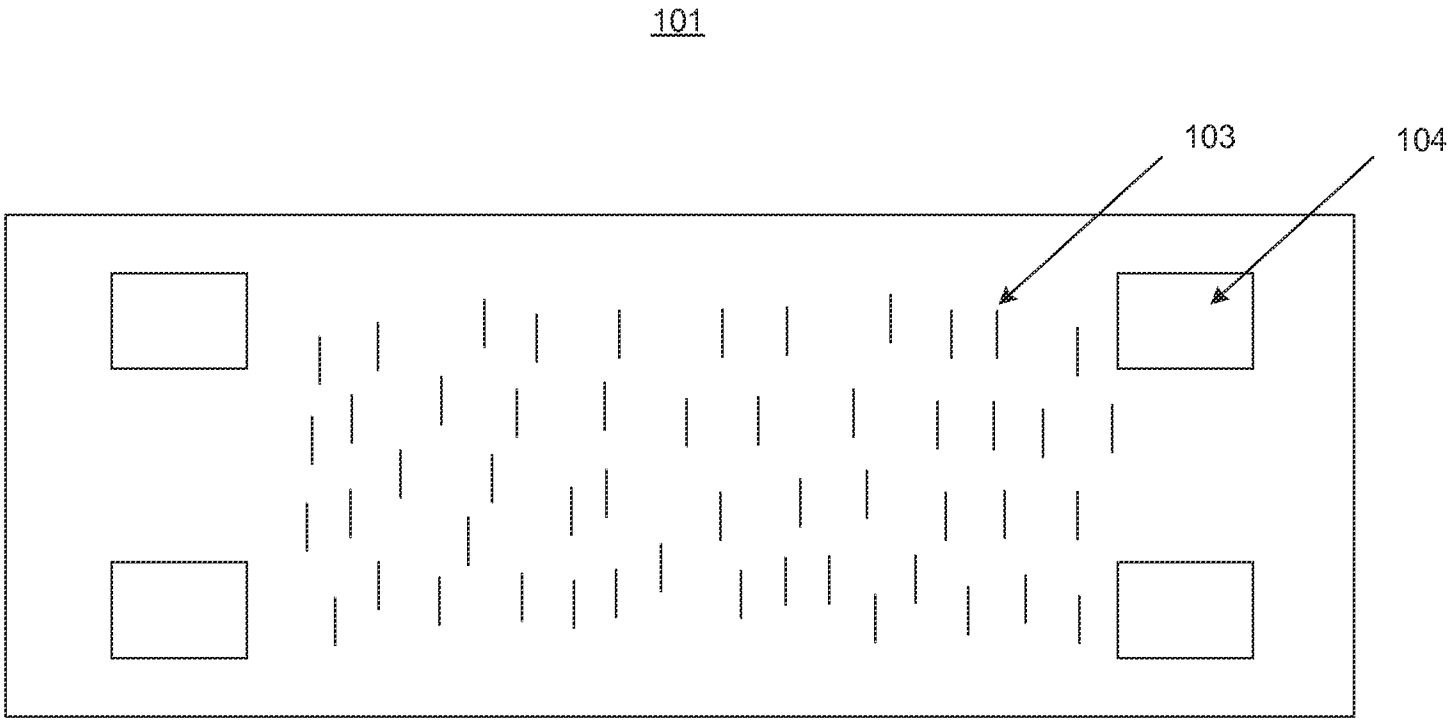
FIG. 2B illustrates a plan view of the inner surface of a top clip member providing a grip mechanism for the wearer's natural hair and opposing openings for snap action, in accordance with embodiments of the present invention.

FIGS. 2A and 2B illustrate the outer and inner surfaces of the top clip member 101 in accordance with embodiments of the present invention. As illustrated in FIG. 2A, the outer surface of the top clip member 101 may include optional small holes 102 if the wearer chooses to sew on the hair extension tracks 600, as illustrated in FIG. 6. The wearer may select the type, quality and color of hair extension tracks to be attached. Again, one or more hair extension tracks may be attached to the outer surface of the top clip member 101 based on the wearer's preferences for the appearance of fuller looking hair. Similarly, the hair extension track 600 may also be attached to the outer surface of the bottom clip member 201 using adhesive materials or thread.

In accordance with embodiments of the present invention, the outer surface of the top clip member 101 may include two or more corresponding openings 104 that may extend partially or completely through the top clip member. Openings 104 can be referred to as cavities, slots or apertures. For example, the optional openings 104 would be utilized if the wearer prefers an optional snap-action lock as an attachment mechanism, where the snaps 204 may go part way or all the way through the outer surface of the top clip member 101 when both clip members 101 and 201 are in the closed position. Thus, the inner surface of the top clip member 101, as illustrated in FIG. 2B, may include two or more openings 104 and optional grooves 103 that would be utilized as a grip mechanism to secure the wearer's natural hair when both clip members, 101 and 201, are in the closed position.

Figure 3A:
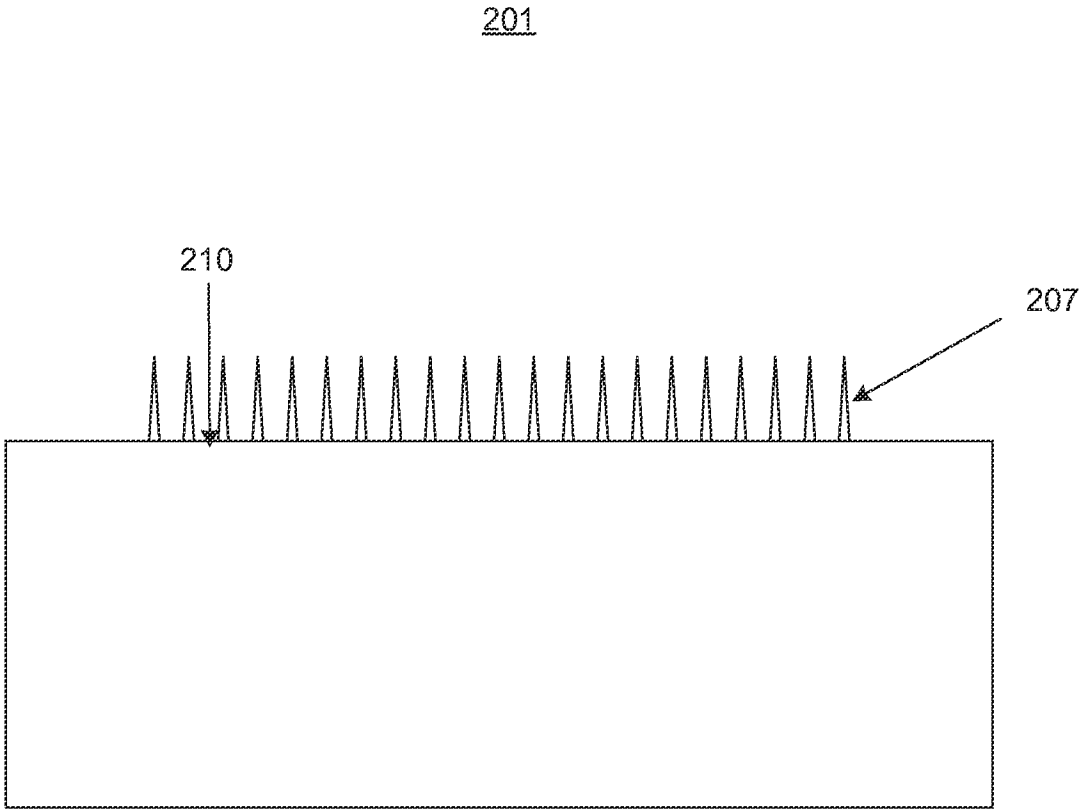
FIG. 3A illustrates a plan view of the outer surface of a bottom clip member, in accordance with embodiments of the present invention.
Figure 3B:
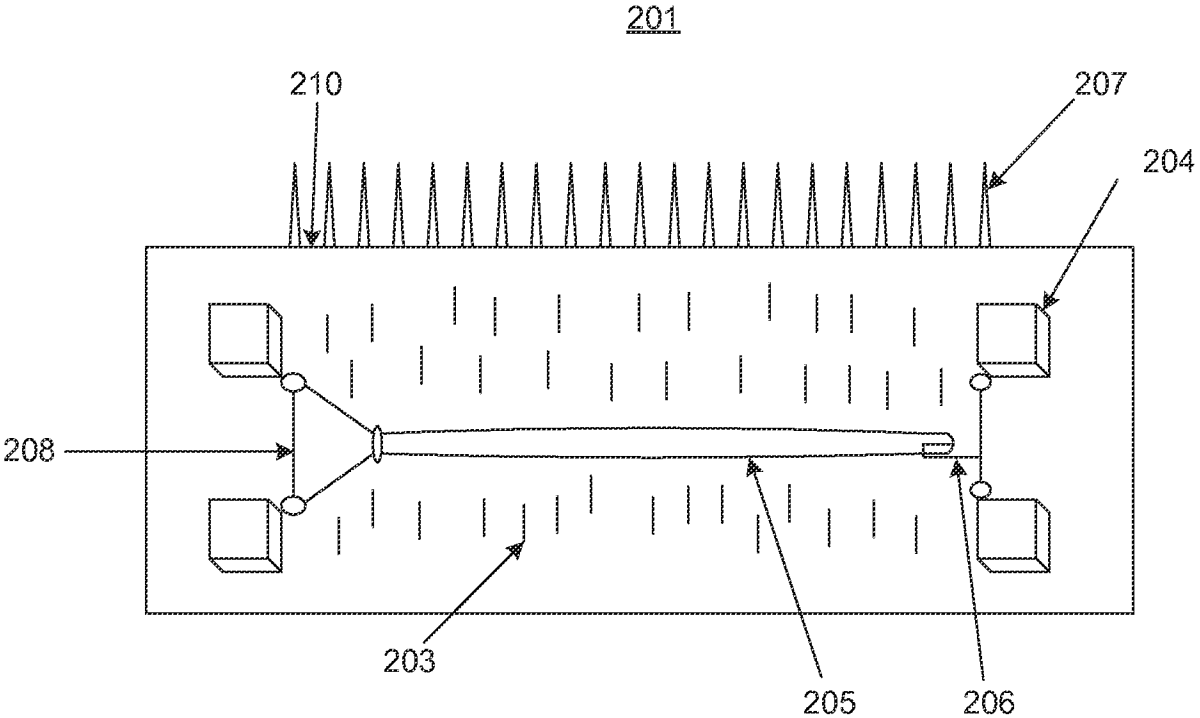
FIG. 3B illustrates a more detailed plan view of the inner surface of a bottom clip member in closed position with opposing snaps, in accordance with embodiments of the present invention.

Referring now to FIGS. 3A and 3B, the outer and inner surfaces of the bottom clip member 201 in accordance with embodiments of the present invention are shown. As illustrated in FIG. 3A, the outer surface of the bottom clip member 201 has a flat surface that may have small holes 102 as previously described in FIG. 2A, and optional comb-like teeth 207 that may be utilized as a mechanism for additional grip to the wearer's natural hair. For example, apparatus 100 without small holes enables the wearer to tape on or glue on one or more hair extension tracks 600 for the appearance of fuller and natural looking hair. The optional comb-like teeth 207 permit the bottom clip member to get as close to the scalp as desired when applied upward against the scalp, allowing the natural hair to fall freely in between the comb-like teeth and ultimately meet the base 210, preventing the natural hair from sliding.

FIG. 3B shows an example of the inner surface of a bottom clip member 201 in accordance with embodiments of the present invention. The inner surface of the bottom clip member 201 may consist of a fastener 205 for tightly securing the natural hair to the clip, an attachment mechanism 206 to firmly engage the fastener 205, snaps 204 that correspond to openings 104 on the top clip member 101 to securely close apparatus 100, optional grooves 203 for additional grip to the wearer's natural hair, and optional comb-like teeth 207 as previously described in FIG. 3A. Fastener 205 is formed of a thin, firm and bendable material that rotates across the center of the bottom clip member 201 and tightly secures the natural hair placed over the inner surface. Two or more snaps 204 may be small and flat in size and shape to easily blend and conceal apparatus 100 when attached to the natural hair. Optional grooves 203 may be utilized as an additional mechanism to hold the natural hair in place.

In another embodiment of the present invention, the inner surface of bottom clip member 201 may include an adhering material as an alternative to the fastener 205, snaps 204, optional grooves 203 and optional comb-like teeth 207. Adhering materials may include tape, glue or wax used in the art of hair extensions.

Figure 4A:
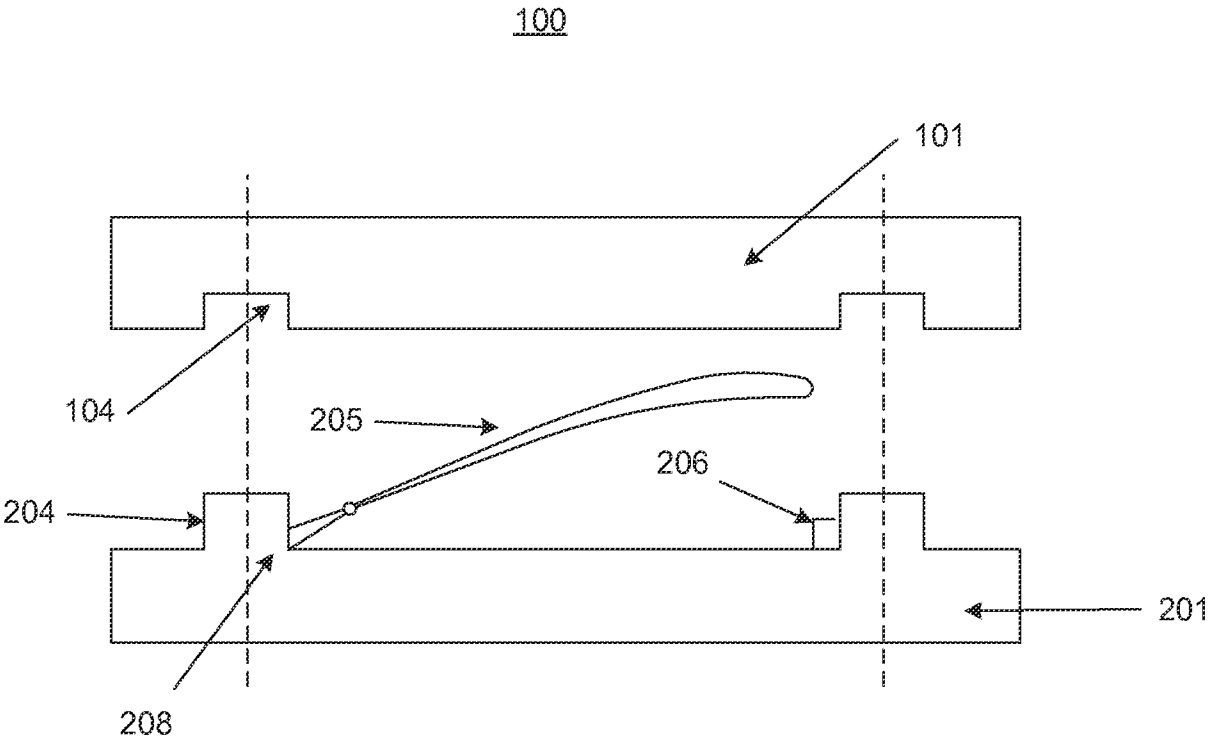
FIG. 4A illustrates a cross-sectional view of the apparatus utilizing cavities with corresponding snaps and additional elements for grip, in accordance with embodiments of the present invention.
Figure 4B:
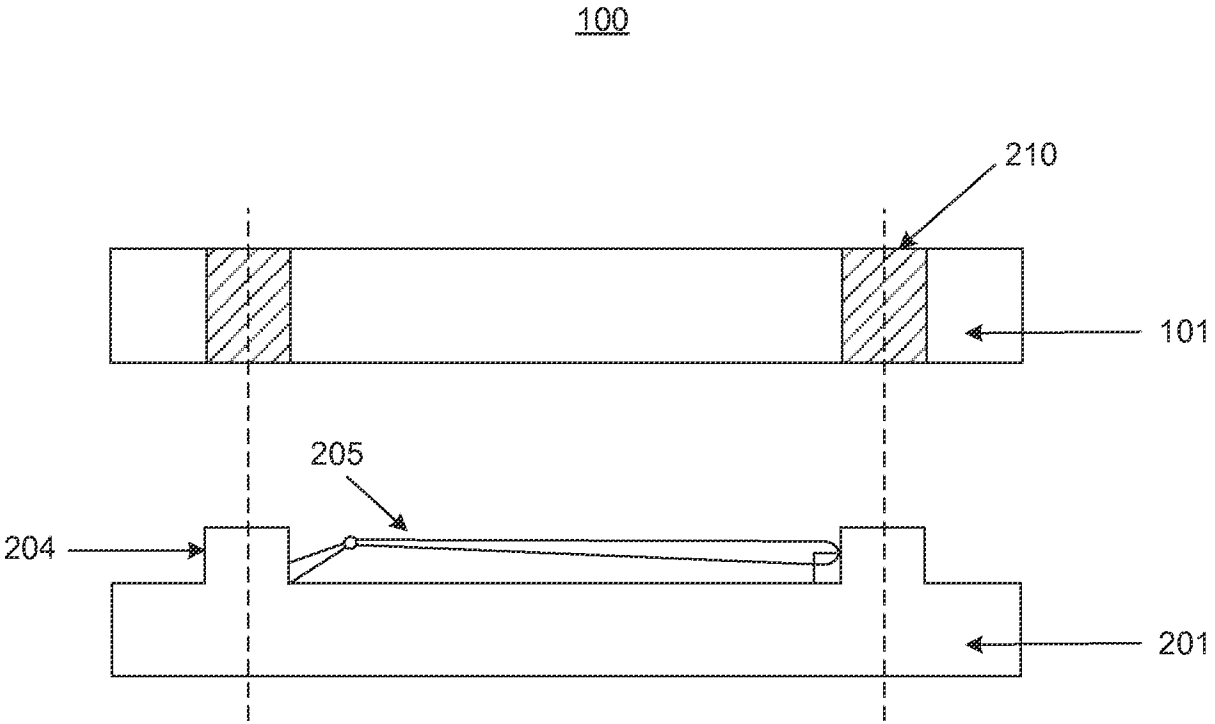
FIG. 4B illustrates a cross-sectional view of the apparatus utilizing apertures with complementary snaps and additional elements for grip, in accordance with embodiments of the present invention.

Referring now to FIGS. 4A and 4B, dual clip members 101 and 201, utilizing snaps 204, and fastener 205 with attachment mechanism 206, in accordance with embodiments of the present invention, are shown. An attachment mechanism 206 may be implemented as a latch-like connector or hinge for example. As illustrated in FIGS. 4A and 4B, apparatus 100 may include two clip members, 101 and 201, which can be firmly attached by snaps 204. The snaps 204 are easily operable and may correspond with openings 104 that extend partially or entirely through the outer surface of the top clip member 201 to create a thinner configured apparatus 100. For example, the wearer may want to use apparatus 100 configured from thinner materials to prevent potential bulk when apparatus 100 is attached to the natural hair, to enhance the realistic appearance of the hair extensions.

In accordance with embodiments of the present invention, the bottom clip member 201 may be applied to the wearer's natural hair as a step in the application process. Unless hair extension tracks 600 will be attached to one or more bottom clip members 201, the wearer may continue to apply the bottom clip member 201 in desired places around the head. As illustrated in FIG. 4B, the bottom clip member is in closed position when fastener 205 is engaged with attachment mechanism 206. Fastener 205 is connected to the bottom clip member by a hinge 208 and is used to secure apparatus 100 to the natural hair. When the bottom clip member 201 is in closed position, the apparatus is retained in a fixed position and will not slide with respect to the wearer's natural hair. In addition, the fastener 205 and attachment mechanism 206 can be formed from a variety of material, such as metal, plastic or rubber, based on preference, for simplicity and convenience to the wearer.

Figure 5:
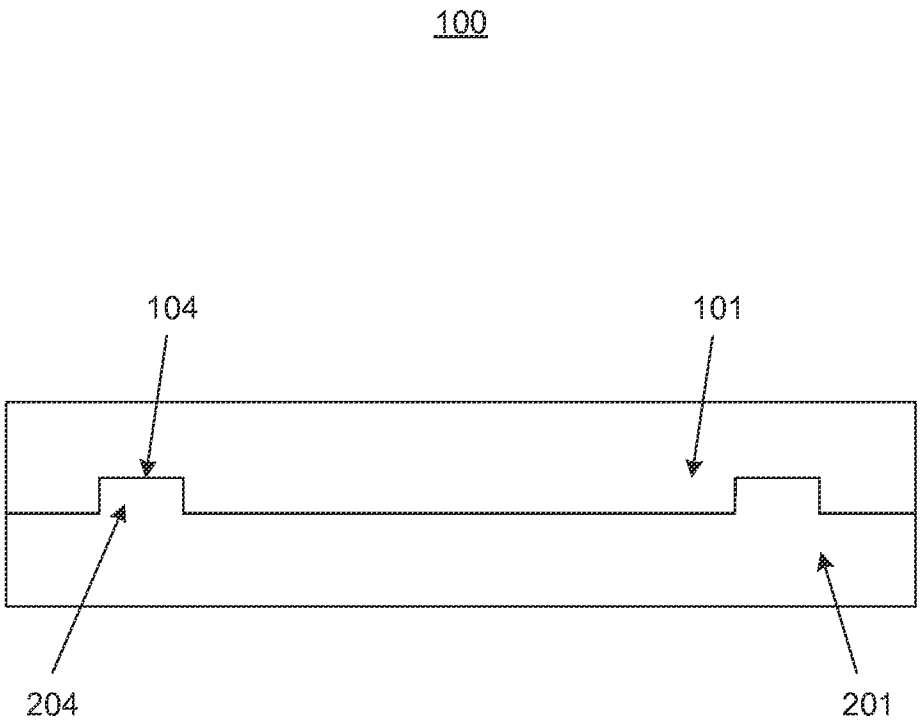
FIG. 5 illustrates a side view of the hair extension apparatus in its closed position, in accordance with embodiments of the present invention.

FIG. 5 shows apparatus 100 in a closed position in accordance with embodiments of the present invention. Two or more snaps 204 may be implemented on the bottom clip member 201 that may not go all the way through the outer surface of the top clip member 101. Both clip members, 101 and 201, can be configured to fit together like a puzzle where opposing snaps 204 on the bottom clip member 201 have corresponding cavities 104 on the top clip member 101. When apparatus 100 is in the closed position, clip members, 101 and 201, are well retained and will not open until the wearer presses on the top clip member 101 in a downward direction.

In another embodiment of the present invention, bottom clip member 201 may not include snaps 204 and openings 104 on the top clip member 101. Instead, clip members, 101 and 201, can be configured with inner surfaces that are smooth and flat. In such an embodiment, apparatus 100 may be attached to the natural hair by use of adhesive materials applied to the inner surfaces of clip members 101 and 201. In this manner, apparatus 100 can be configured in a variety of forms that may allow the wearer to select a more permanent and longer wearing means for applying and using hair extensions.

FIG. 6 (Conventional art) illustrates an example of a hair extension track as may be used with embodiments of the present invention. Hair extension tracks 600 used in the hair extension application process are readily available to consumers and are selected by the wearer. Before starting the application process, the type, quality, and color of hair extension tracks 600 are a few characteristics a wearer will consider when selecting potential hair extensions. For example, the hair extension track 600 may be formed from natural hair, synthetic hair or a combination thereof. For instant hair extensions that are self applied and convenient, the hair extension track 600 generally includes an elongated thin and flexible member 601 sewn or braided to hair extensions 602, comprising multiple strands of hair.

FIG. 7A shows an example of a hair extension track 600 attached to the outer surface of the top clip member 101 in accordance with embodiments of the present invention. One or more hair extension tracks 600 can be attached to a top clip member 101 for fuller hair extensions. The hair extension track 600 can be attached to a top clip member 101 using any suitable adhesive material 701 or thread. Some adhesive materials 701 may include, but are not limited to, bonding materials used in the art of hair extension applications. The elongated thin and flexible member 601 of the hair extension track 600 may be longitudinally attached to the outer surface area of apparatus 100, across the upper edge. As a result, the hair extensions 602, comprising multiple strands of hair, may extend at least partially over the entire outer surface area of the top clip member 101, thereby reducing the ability to see the device when the hair extensions are applied to the wearer's natural hair.

FIG. 7B illustrates hair extension tracks 600 attached to multiple top clip members 101, in accordance with embodiments of the present invention. A wearer may choose to apply hair extensions 602 of wider widths around the head, thereby using multiple clip members, 101 and 201, to extend the width of hair extensions 602 applied around the head. In this manner, the hair extension tracks 600 can be attached to the outer surface areas of each clip member, 101 and 201, when apparatus 100 is in the closed position allowing the top and bottom clip members, 101 and 201, to align when applied around the head. If multiple clip members are used for larger width hair extensions applied around the head, the bottom clip members 201 may be applied first to firmly secure the natural hair to the working platform. The top clip member 101 can then be connected to the bottom clip member 201, thereby closing apparatus 100.

Figure 8:
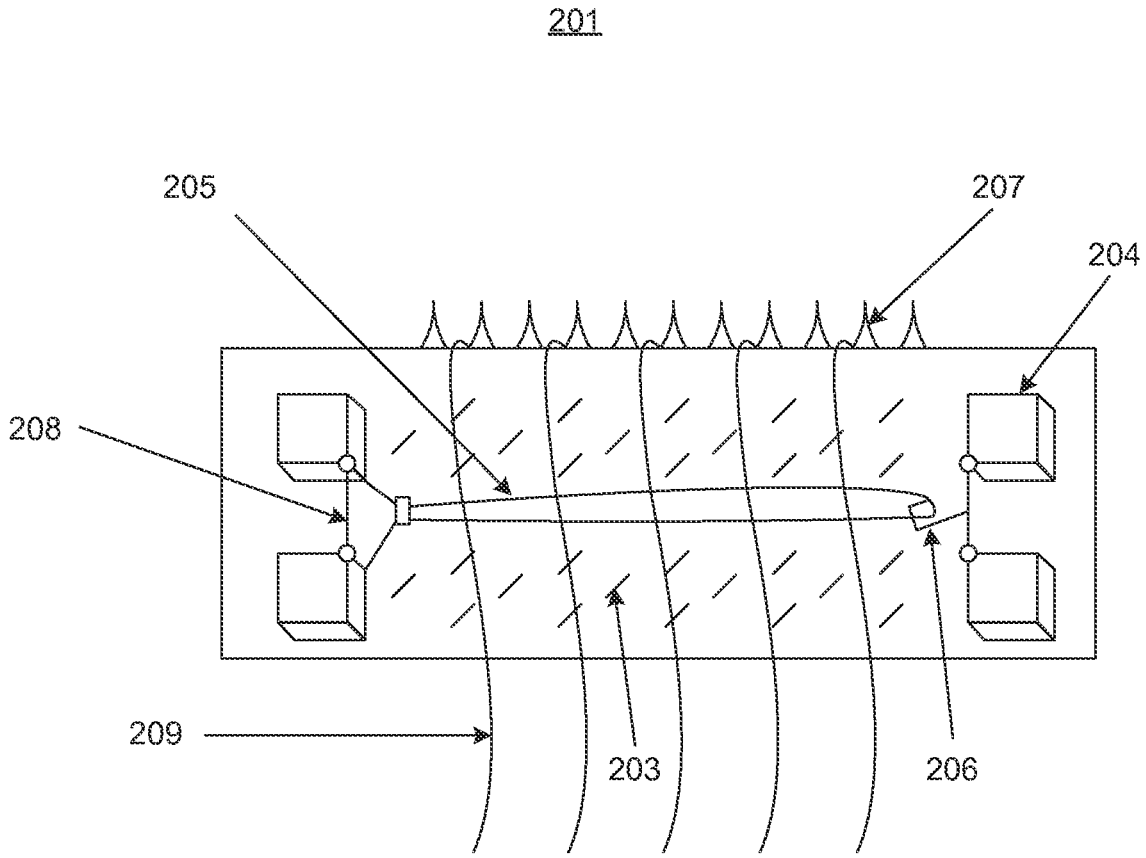
FIG. 8 illustrates a plan view of the inner surface of a bottom clip member as it appears when the wearer's natural hair is secured by the fastener, in accordance with embodiments of the present invention.

FIG. 8 illustrates examples of components implemented on a bottom clip member 201 to provide additional grip to the natural hair, in accordance with embodiments of the present invention. If the bottom clip member 201 is positioned close to the scalp, the ability for the bottom clip member 201 to move or slide unintentionally along the natural hair will be limited and the appearance of realistic and natural looking hair will be enhanced. For example, when the natural hair is pulled over the inner surface of the bottom clip member 201, and the bottom clip member 201 is applied in an upward direction along the scalp, the natural hair 209 will meet the base of the comb-like teeth 207, thereby firmly gripping the natural hair. Fastener 205 may further provide additional grip to the natural hair when engaged with the attachment mechanism 206, and again may restrict the bottom clip member 201 from any unintentional movement.

Figure 9:
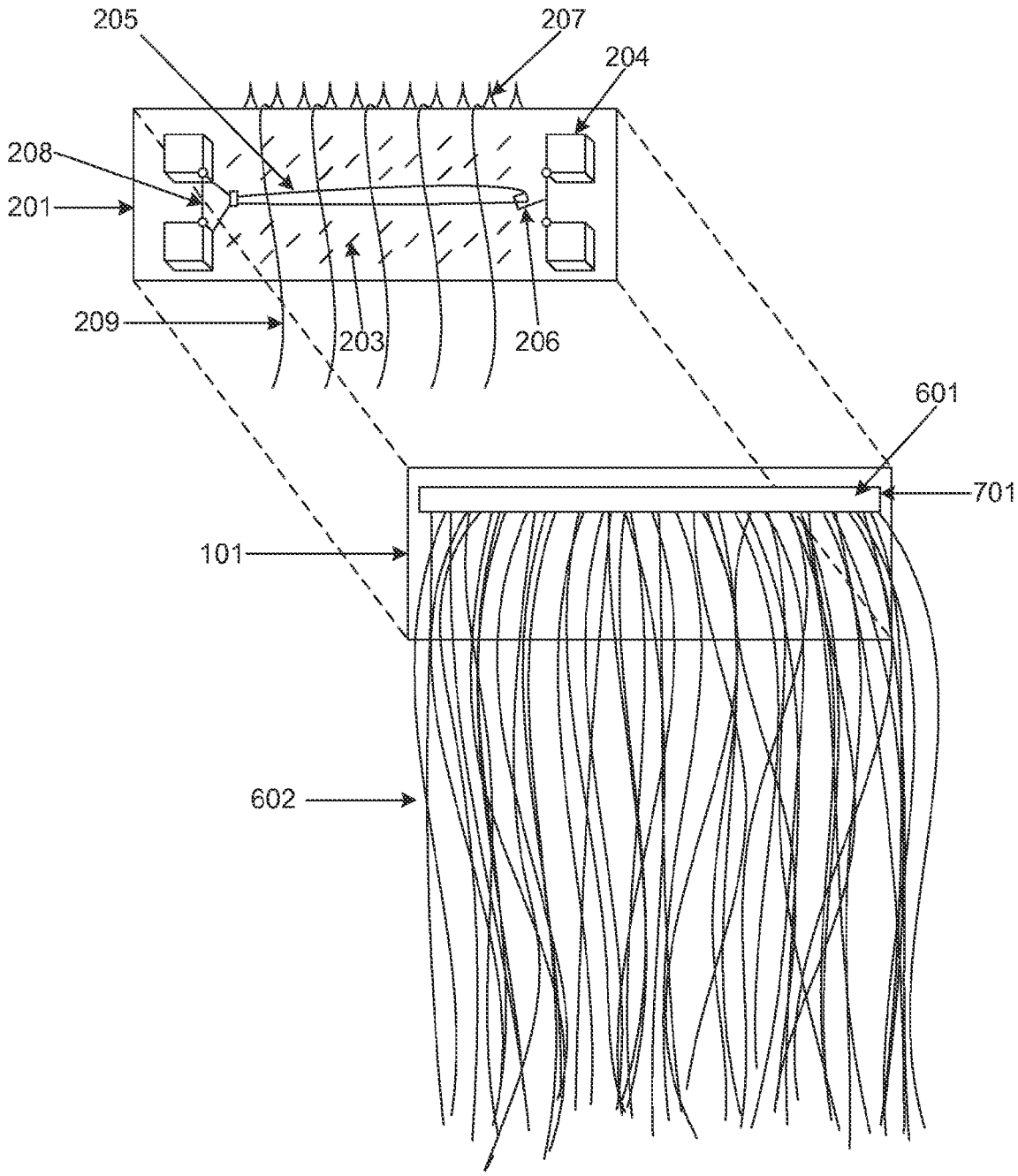
FIG. 9 illustrates a perspective view of an example of a process for connecting dual clip members, in accordance with embodiments of the present invention.

Reference will now be made to FIG. 9, illustrating a process for attaching apparatus 100, including the attached hair extension tracks 600, to the natural hair, in accordance with embodiments of the present invention. As illustrated in FIG. 9 and previously presented in FIG. 1, apparatus 100 may include two clip members 101 and 201. As previously described in FIG. 7A, the hair extension tracks 600 can be attached to the top clip member 101 by bonding materials or thread. Bonding materials may include tape or glue, or any well known material used in the art of hair extension applications. Although hair extension tracks 600 are illustrated as being attached solely to the top clip member 201, hair extension tracks 600 may also be attached to the bottom clip member if multiple apparatuses will be used in the hair extension device.

Figure 10A:
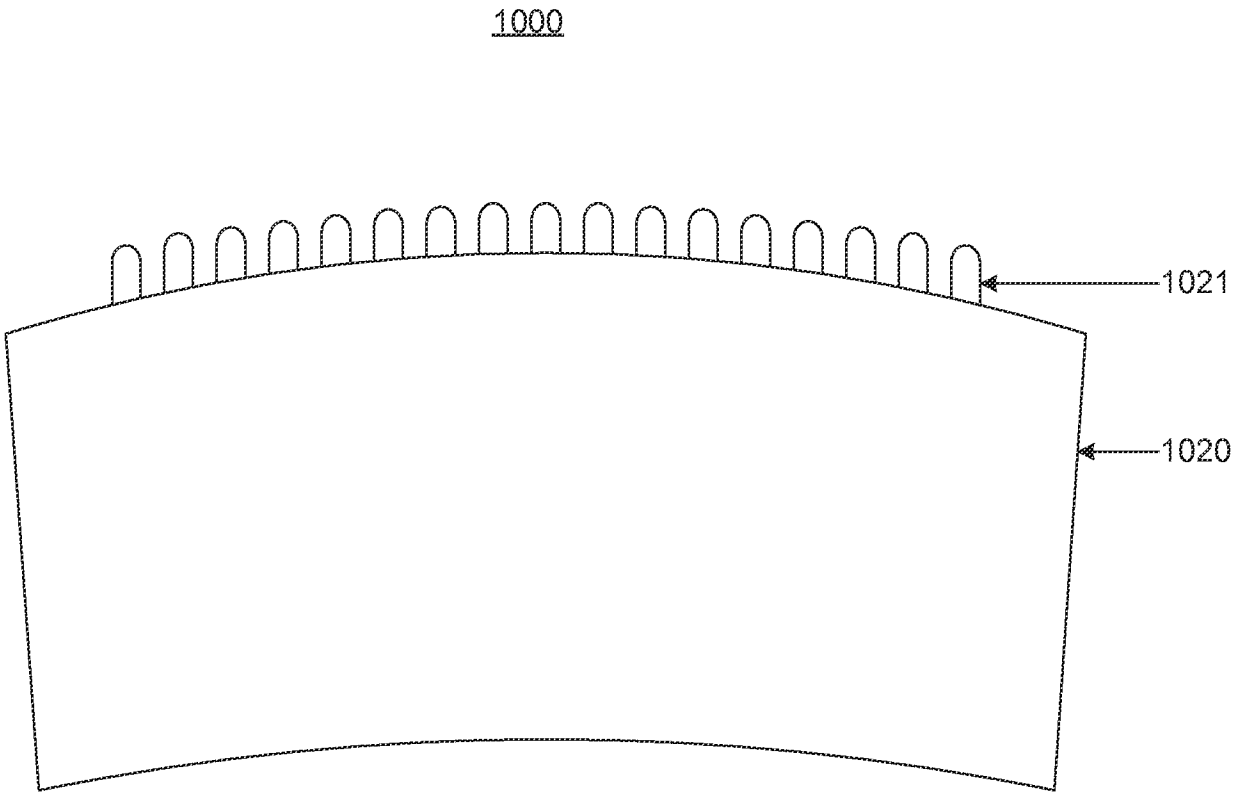
FIG. 10A illustrates a back view of a single clip member, in accordance with embodiments of the present invention.
Figure 10B:
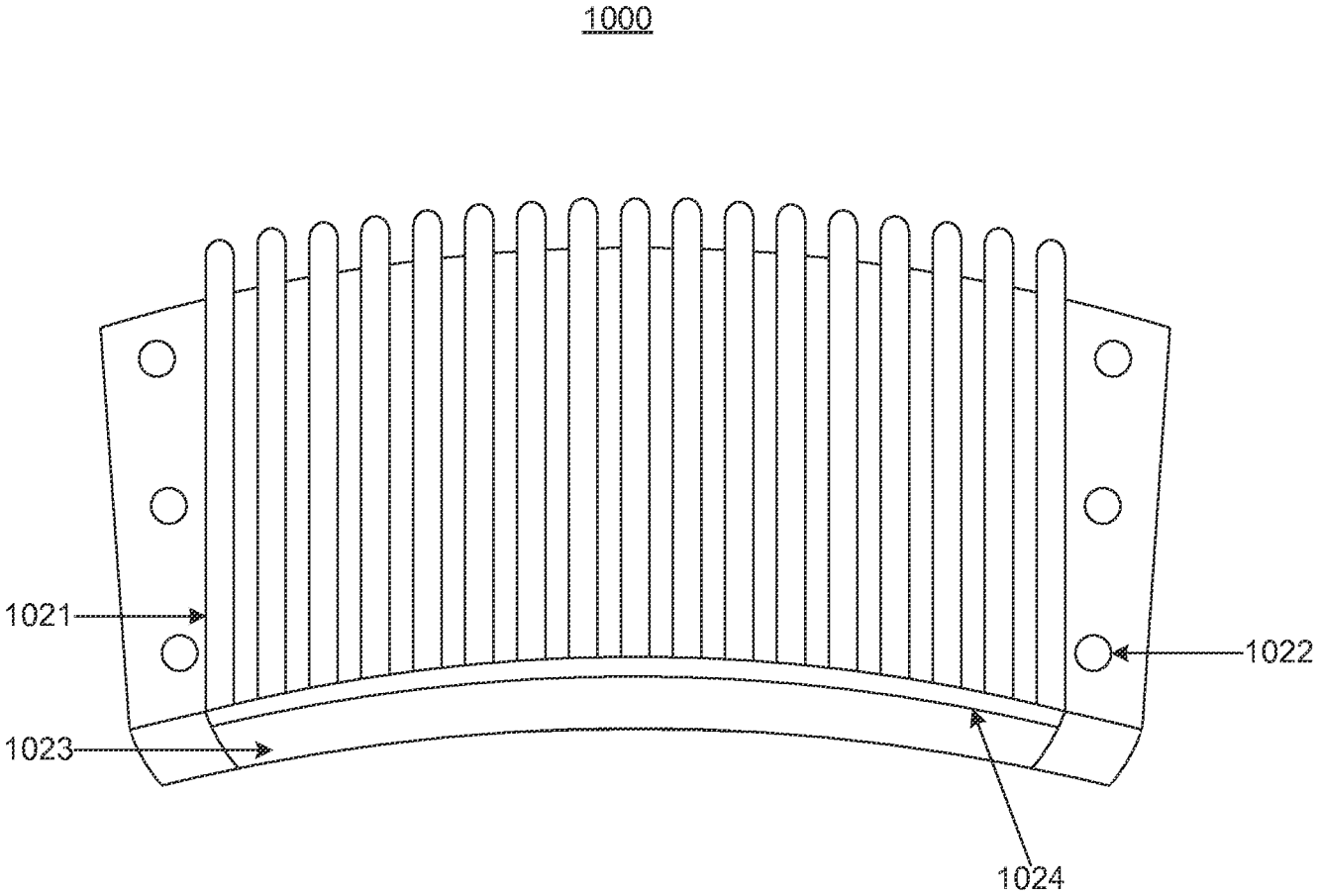
FIG. 10B illustrates a back view of a single clip member, in accordance with embodiments of the present invention.

In other embodiments of the present invention, an apparatus 1000 comprising a single clip member includes a main body 1020 and a row of comb-like teeth 1021 as illustrated in FIGS. 10A and 10B. In general, a single clip member apparatus 1000 may be advantageous for a wearer who may be interested in an alternative method for customizing an instant hair extension device that is less-time consuming and more easily operable. The main body 1020 may include several features similar to those previously described in FIG. 1. Apparatus 1000 can also be opened and closed by snap-lock action. The outer surface of the main body 1020 and comb-like teeth 1021 may be fabricated of any thin, solid strip of any suitable material, such as metal, rubber, plastic or any combination thereof. In addition, hair extension tracks 600 may be bonded to the outer surface of the main body 1020. As previously mentioned, bonding materials may include tape or glue used in the art of hair extension applications. The comb-like teeth 1021 are attached at the bottom inner base 1023 of the clip, extending longitudinally along and past the inner top edge of outer surface of the main body 1020.

In one implementation, the main body 1020 of apparatus 1000 may include at least one row of consecutive small holes 102 along the upper edge of the clip for sewing hair extension tracks 600. The upper edge of the clip is the edge of the clip that is closest to the scalp. In this manner, the thread is utilized as an attachment mechanism for hair extension tracks 600 and apparatus 1000.

Figure 11A:
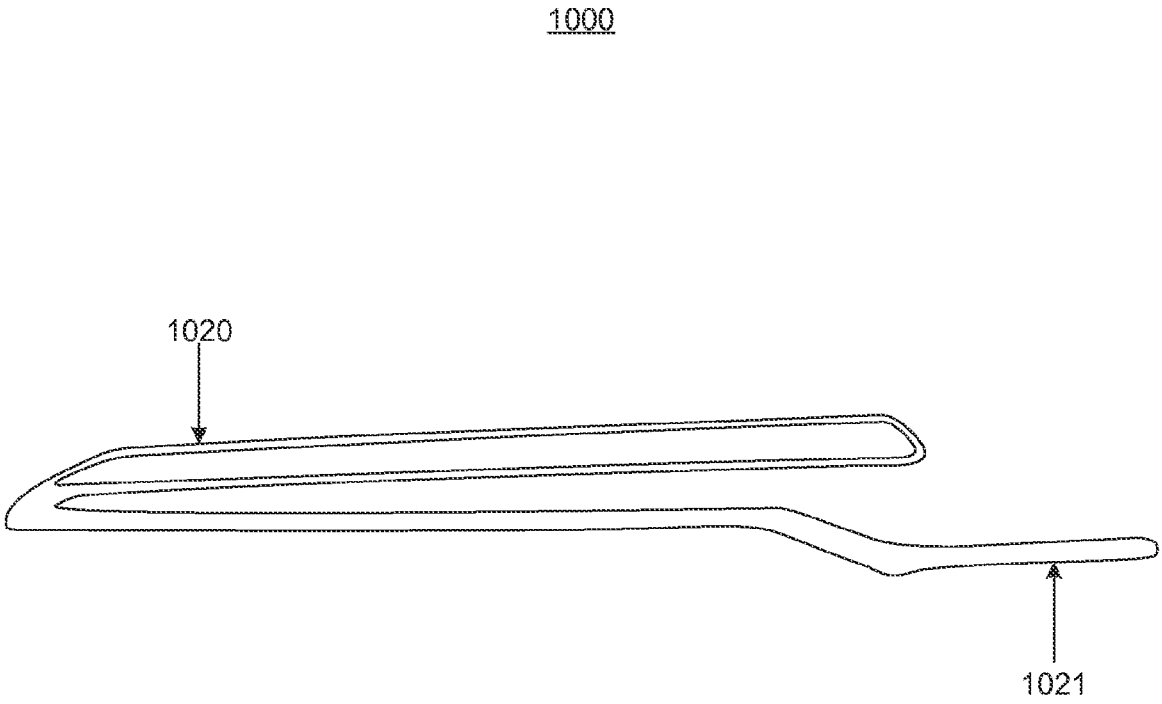
FIG. 11A illustrates a side view of a single clip member in the open position, in accordance with embodiments of the present invention.
Figure 11B:
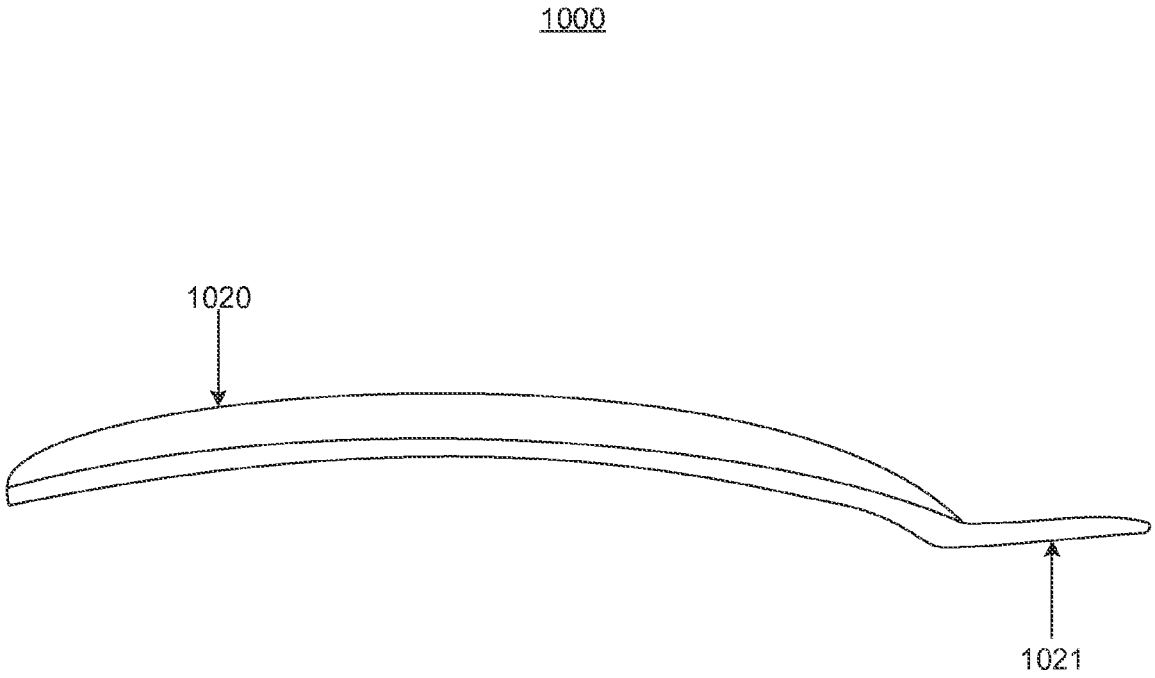
FIG. 11B illustrates a side view of a single clip member in the closed position, in accordance with embodiments of the present invention.

FIGS. 11A and 11B illustrate a side-view of apparatus 1000, in accordance with embodiments of the present invention. When apparatus 1000 is properly applied to the natural hair, the comb-like teeth 1021 pointing upward against the scalp retain the natural hair in the complementary slots 1024, or spaces between the teeth, formed at the bottom inner base 1023 of the clip, thereby providing resiliency to hold the clip in place and preventing any unwanted downward movement along the hair shaft. Apparatus 1000 can be easily opened and closed with a snap-action lock feature.

FIG. 11A shows an example of apparatus 1000 comprising a single clip member in the open position, in accordance with embodiments of the present invention. Again, the row of comb-like teeth 121 are applied upward along the scalp and are disposed longitudinally, extending slightly past the top edge of the clip. The natural hair is placed in between the comb-like teeth 121 and the inner surface of the single clip member 120.

FIG. 11B shows an example of an apparatus 1000 comprising a single clip member in the closed position, in accordance with embodiments of the present invention.

Figure 12:
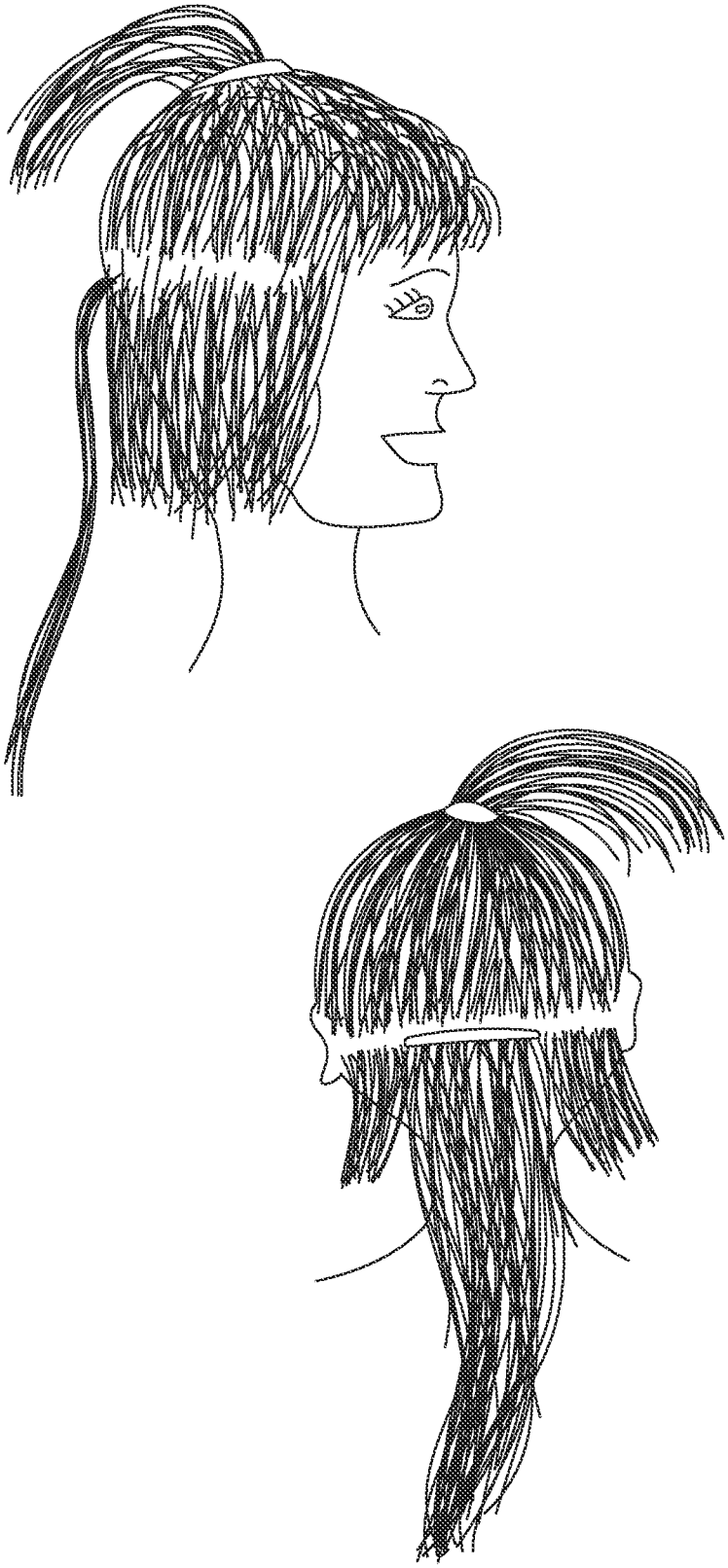
FIG. 12 illustrates perspective views of a wearer with the hair extension devices applied to a section of the natural hair, in accordance with embodiments of the present invention.

FIG. 12 illustrates perspective views of a wearer with the hair extensions applied to a section of the natural hair, in accordance with embodiments of the present invention.

While the foregoing description and drawings represent embodiments of the present invention, it will be understood that various additions, modifications and substitutions may be made therein without departing from the spirit and scope of the principles of the present invention. One skilled in the art will appreciate that the invention may be used with many modifications of form, structure, arrangement, proportions, materials, elements, and components and otherwise, used in the practice of the invention, which are particularly adapted to specific environments and operative requirements without departing from the principles of the present invention. The presently disclosed embodiments are therefore to be considered in all respects as illustrative and not restrictive, and not limited to the foregoing description.

CONCLUSION

A hair extension device comprising single and dual clip member apparatuses having a first (101) substantially solid body structure disposed for attaching hair extension tracks using adhering materials used in the art of hair extensions, such as tape, glue or wax; and second (201) substantially solid body structure disposed for attaching to a wearer's natural hair; wherein said first and second substantially solid body structures include a mechanism for attaching said first and second substantially solid body structures together (such that said hair extension track is functionally coupled to said natural hair) to have opened and closed positions, and secure the natural hair when natural hair is placed in between a first and second substantially solid body structure.

In an alternate embodiment, an apparatus includes a main body and row of comb-like teeth, wherein said row of comb-like teeth are disposed longitudinally from the bottom edge, across the main body, and past the upper edge of the clip member, pointing upward when applied properly to the natural hair; thereby providing complementary mating between the natural hair and the slots formed at the base of the comb-like teeth.

A method for customizing an in instant clip-in hair extension device, providing the ability for hair extension tracks to be applied across the upper edge of a clip member, wherein the upper edge is the edge of said clip member that is the closest distance between the scalp and the natural hair; and extend laterally over and past the entire outer region of the clip, thereby concealing the appearance of the clip and easily blending the hair extension device with the natural hair when properly applied.

What is claimed is:

1. A hair clip for attaching one or more hair extension tracks comprising:

a top clip member for attaching one or more hair extension tracks; and a bottom clip member that is removably attached to the top clip member to secure hair between the top clip member and the bottom clip member, the bottom clip member having an outer surface and an opposite inner surface, the bottom clip member including an attaching member in the inner surface that attaches the top clip member to the bottom clip member, the attaching member having a plurality of raised members to removably attach the bottom clip member to the top clip member, a fastener to secure the hair placed over the inner surface of the bottom clip member to the bottom clip member, the fastener secured to the bottom clip member using a hinge that is attached to one or more of the raised members, and a comb-like teeth on a top edge of the bottom clip member, the comb-like teeth extending out of the top edge and past the top edge.

2. The hair clip of claim 1, wherein the raised members on the inner surface snap lock into corresponding slots on the top clip member.

3. The hair clip of claim 1, wherein the top clip member includes a plurality of slots that snap lock to a corresponding plurality of raised members of the attaching member of the bottom clip member.

4. The hair clip of claim 1, wherein the fastener is made of a thin, firm and bendable material.

5. The hair clip of claim 1, wherein the fastener is configured to rotate on the hinge.

6. The hair clip of claim 5, wherein the fastener is configured to rotate towards and away from the inner surface of the bottom clip member.

7. The hair clip of claim 5, wherein the bottom clip member further includes a fastener lock to hold the fastener in a locked position.

8. The hair clip of claim 7, wherein the fastener lock includes at least one of a hook or a latch.

9. The hair clip of claim 7, wherein the fastener is configured to secure the hair when the fastener is in the locked position.

10. The hair clip of claim 1, wherein the comb-like teeth faces upwards and against scalp of a user when worn by the user.

11. The hair clip of claim 1, wherein the bottom clip member includes a set of grooves on the inner surface to hold the hair in position.

12. The hair clip of claim 1, wherein the top clip member includes an hair extension attachment means to attach the one or more hair extension tracks to the top clip member.

13. The hair clip of claim 12, wherein the hair extension attachment means includes a plurality of holes using which the one or more hair extension tracks can be stitched to the top clip member.

14. The hair clip of claim 12, wherein the one or more hair extension tracks is attached to an outer surface of the top clip member using adhering materials.

15. The hair clip of claim 1, wherein the top clip member and the bottom clip member are substantially solid body structures made of flexible material.

16. A hair clip for attaching one or more hair extension tracks comprising:

a top clip member including means for attaching one or more hair extension tracks; and a bottom clip member including:

means for securing hair placed over an inner surface of the bottom clip member to the bottom clip member, means for removably attaching the top clip member to the bottom clip member, the top clip member concealing the inner surface of the bottom clip member, the means for securing hair secured to the bottom clip member using a hinge that is attached to the means for removably attaching the top clip member, and a comb-like teeth on a top edge of the bottom clip member, the comb-like teeth extending out of the top edge and past the top edge.

17. The hair clip of claim 16, wherein the top clip member and the bottom clip member are substantially solid body structures made of flexible material.

* * * * *